US010443346B2

(12) United States Patent
Abney et al.

(10) Patent No.: US 10,443,346 B2
(45) Date of Patent: Oct. 15, 2019

(54) CEMENT VALVE

(71) Applicant: DLA-Desheim Systems, Inc., Seagoville, TX (US)

(72) Inventors: David L. Abney, Rowlett, TX (US); Valeriy Kasyanenko, University Park, TX (US)

(73) Assignee: DLA-Desheim Systems, Inc., Seagoville, TX (US)

( * ) Notice: Subject to any disclaimer, the term of this patent is extended or adjusted under 35 U.S.C. 154(b) by 215 days.

(21) Appl. No.: 15/595,843

(22) Filed: May 15, 2017

(65) Prior Publication Data

US 2017/0335657 A1 Nov. 23, 2017

Related U.S. Application Data

(60) Provisional application No. 62/338,331, filed on May 18, 2016.

(51) Int. Cl.

| | |
|---|---|
| ***E21B 34/10*** | (2006.01) |
| ***E21B 34/14*** | (2006.01) |
| ***E21B 33/14*** | (2006.01) |
| ***E21B 43/26*** | (2006.01) |
| *E21B 34/00* | (2006.01) |

(52) U.S. Cl.

CPC ..... *E21B 34/10* (2013.01); *E21B 33/14* (2013.01); *E21B 34/103* (2013.01); *E21B 34/14* (2013.01); *E21B 43/26* (2013.01); *E21B 2034/002* (2013.01)

(58) Field of Classification Search

CPC ..... E21B 34/10; E21B 34/103; E21B 34/14; E21B 33/14; E21B 43/26; E21B 2034/002

See application file for complete search history.

(56) References Cited

U.S. PATENT DOCUMENTS 8,327,945 B2 * 12/2012 Gette ..... E21B 33/04 166/120

2010/0084146 A1 * 4/2010 Roberts ..... E21B 23/04 166/386

* cited by examiner

*Primary Examiner* — Nicole Coy
*Assistant Examiner* — Yanick A Akaragwe
(74) *Attorney, Agent, or Firm* — John G. Fischer; Scheef & Stone, L.L.P.

(57) ABSTRACT

A new cement valve is disclosed for use in the production of an oil or gas well where hydraulic fracturing has been employed. In particular, the embodiments include a cement valve having a reclosable valve. When properly located, a first piston sleeve is hydraulically actuated to open the cement ports on the tool. After the cement has been pumped through the tool and the cement ports to a wellbore annulus, a blocking ball is dropped to stop flow through the tool. The tool is internally pressurized. The pressure overcomes shear pins to force downward movement of a ball housing inside the cement valve. This movement translates a travelling pin along a guide path, which rotates a ball valve inside the ball housing, releasing the blocking ball to open up the internal flow path through the cement valve at the same time the cement ports are closed.

7 Claims, 16 Drawing Sheets

CEMENT VALVE

TECHNICAL FIELD

The present disclosure relates to a new cement valve for use in the production of an oil or gas well where hydraulic fracturing has been employed. In particular, the present disclosure includes a cement valve having a reclosable valve. When properly located, a first piston sleeve is hydraulically actuated to open the cement ports on the tool. After the cement has been pumped through the tool and the cement ports to wellbore annulus, a blocking ball is dropped to stop flow through the tool. The tool is internally pressurized. The pressure overcomes ball valve shear pins to force downward movement of a ball housing inside the cement valve. This movement translates a travelling pin along a guide path, which rotates a ball valve inside the ball housing, opening up the internal flow path of the cement valve at the same time the cement ports are closed.

BACKGROUND

In the production of oil, gas and geothermal energy, drilling operations are used to create boreholes, or wells, in the earth. In recent years, lateral drilling into the targeted producing zone has become the preferred drilling procedure for extracting hydrocarbons from shale formations. In this practice, multiple engagements with the target zone are provided to allow an increased flow of production fluid into the wellbore. This is conventionally accomplished with a completion liner having interspaced packers that are hydraulically, mechanically set or swellable. Sleeve valves provided between the packers are operable with hydraulic pressure. Each sleeve valve has a circular valve seat for receivable of a ball known as a "frac ball." Progressing down the completion liner, each sequential valve seat is smaller in opening such that the smallest valve is at the bottom of the system.

To open a sleeve valve for hydraulically fracturing a designated interval, a first, smallest frac ball, is dropped into the system for seating in the sleeve valve furthest from the surface and stopping circulation. The small frac ball will pass through the valve seat of every other sleeve valve before coming to rest on the final valve seat. In this position, the ball blocks the flow of fluid beyond the valve seat. The fluid in the production liner is then pressurized. The high pressure on the surface side of the frac ball forces the sleeve downward, exposing ports to the formation. When the lowest sleeve has been opened, the next larger frac ball is dropped to seat in the penultimate sleeve valve. This process is continued until all of the sleeve valves have been opened. When all of the reservoir sections have been treated, the well is allowed to flow back, flushing all of the frac balls back to the surface where they are captured in a ball trap.

Before this process can be initiated, it is necessary to firmly position the completion system in place in the open-hole environment. To accomplish this, a liner hanger is positioned inside the casing string, and a packer is set about the liner hanger. A cementing valve is positioned near the top of the completion system, below the liner hanger and above the packers and sleeve valves of the completion system.

A circulation blocking ball is dropped to set on a seat in a circulation valve (circulation sub) at the lowest end of the completion string. This increases the pressure inside the string and sets liner hanger slips and open hole packers. Continuation of pressure increase actuates a hydraulic valve inside the cement valve, opening the cement ports so that cement can be pumped through the tool and into the well annulus. When completed, a blocking ball or plug is sent into the tool. This allows pressure to be built-up in the tool. When the pressure is sufficient to overcome shear pin resistance, a sleeve is hydraulically repositioned to again cover the cement ports. A mill is then run into the completion string to mill out the plug or blocking ball.

It is desirable to have the ability to close the cement ports without having to trip a milling tool into the cement valve to mill the plug or blocking ball. It is further desirable to begin fracking operations without having to wait for the cement to set.

The embodiments of the present disclosure provide a unique solution to the engineering constraints and challenges of providing a cement valve that can be reclosed without the need to run a milling tool into the system to remove the blocking ball or plug, reducing the risks of problems that occur in these operations, and without the waste of time and tooling for this separate operation. It is a further advantage of the present disclosure that it is not necessary to wait for the cement to set before beginning fracking operations, thus significantly reducing the total project time of well completion.

SUMMARY

The present disclosure is for a cement valve of a completion system capable of closure of the cement ports and simultaneous reopening of the central flow through the cement valve. In one embodiment, the cement valve comprises a valve body having an upper end and a lower end. A guide pin extends between the valve body and the ball housing. A ball is rotatably mounted in the ball housing. The ball has a converging path extending between a first port and a ball port. The ball also has a flow path extending between a third and fourth port on the ball. The flow path is perpendicular to, and intersecting with, the converging path. A lever is connected to the ball, such that translation of the ball housing relative to the valve body engages the guide pin with the lever and rotates the ball.

In another embodiment, dropping a ball to plug the ball port forces the ball housing to move towards the lower end of the valve body and rotation of the ball to align the flow path with a centerline of the cement tool. In another embodiment, a pair of opposing flats is oriented perpendicular to each of the first and ball ports and to the third port and the fourth port. The lever has a cam portion positioned for engagement with the guide pin.

In another embodiment, moving the ball housing towards the lower end of the valve body closes the cement ports. In another embodiment, there is a slot on the flat. The lever has a key on one end and a cam on its opposite end. The lever key engages the slot on the ball.

Locating a blocking ball on the ball port and increasing the pressure inside the valve body causes the ball housing to move towards the lower end of the valve body. Moving the ball housing towards the lower end of the valve body closes the cement ports. This movement further causes the guide pin to engage the cam, rotating the ball substantially ninety degrees inside the valve body. Rotating the ball ninety degrees aligns the flow path in the ball with the center of the valve body.

In another embodiment, a hydraulic piston is translatably located inside the valve body. The hydraulic piston is aligned with the cement ports to prevent flow through the cement ports. Piston shear pins prevent translation of the piston inside the valve body. Sufficiently pressurizing the interior of the valve body shears the shear pins and forces the hydraulic piston towards the lower end of the valve body to open the cement ports.

As will be understood by one of ordinary skill in the art, the assembly disclosed may be modified and the same advantageous result obtained.

BRIEF DESCRIPTION OF THE DRAWINGS

The objects and features of the present disclosure will become more readily understood from the following detailed description and appended claims when read in conjunction with the accompanying drawings in which like numerals represent like elements.

The drawings constitute a part of this specification and include exemplary embodiments to the present disclosure, which may be embodied in various forms. It is to be understood that in some instances various aspects of the present disclosure may be shown exaggerated or enlarged to facilitate an understanding of the present disclosure.

DETAILED DESCRIPTION

The following description is presented to enable any person skilled in the art to make and use the various embodiments of the present disclosure, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not intended to be limited to the embodiments shown, but is to be accorded the widest scope consistent with the principles and features disclosed herein.

Figure 1:
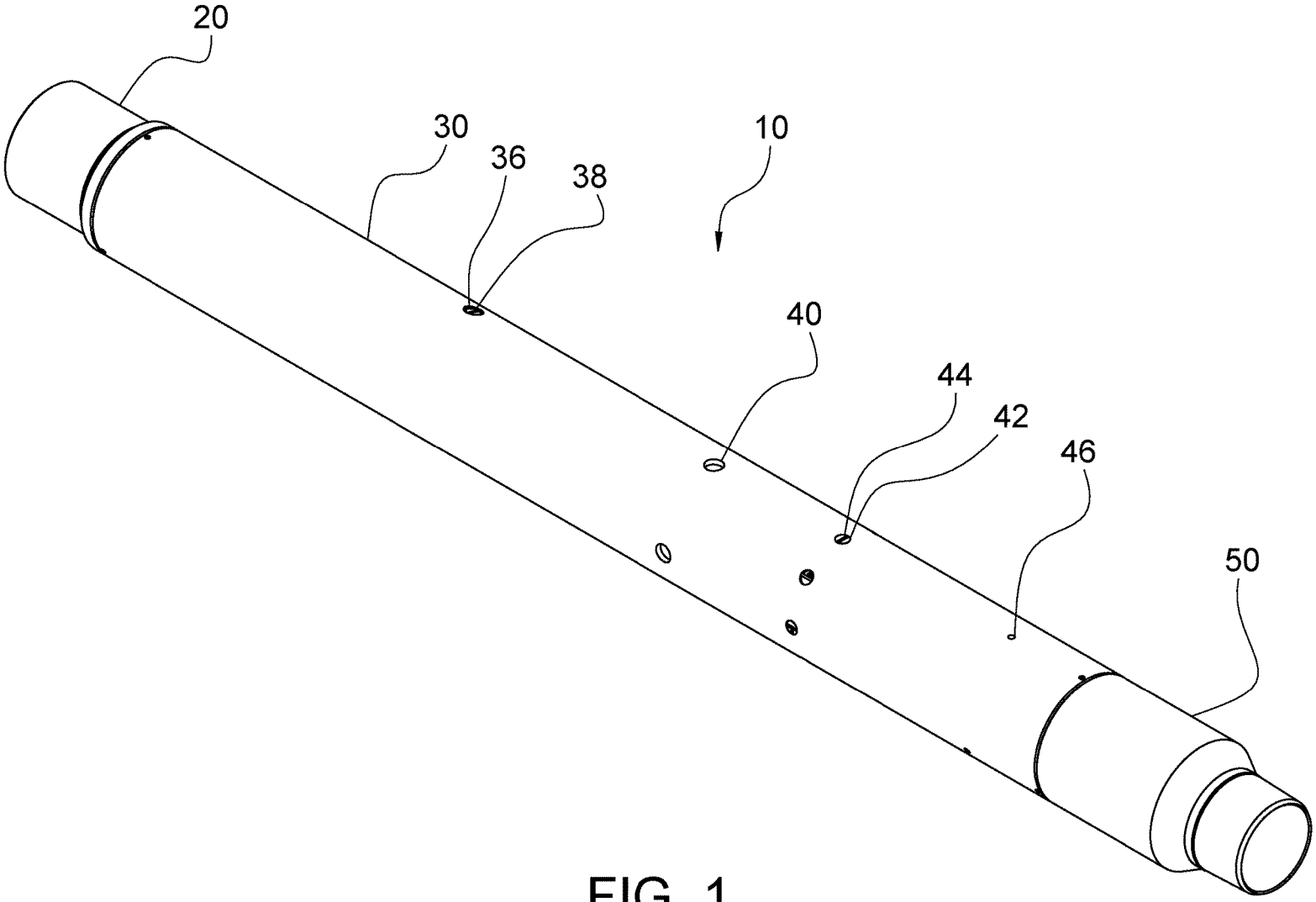
FIG. 1 is an isometric view of an embodiment of the cement valve of the present disclosure.

FIG. 1 is an isometric view of an embodiment of cement valve 10 of the present disclosure. As seen in this view, cement valve 10 has a valve body 30. A top sub 20 is coupled to the upper end of body 30 and provides a box connection for coupling with other completion string members. A bottom sub 50 is coupled to the lower end of body 30 and provides a pin connection for coupling with other completion string members.

Figure 2:
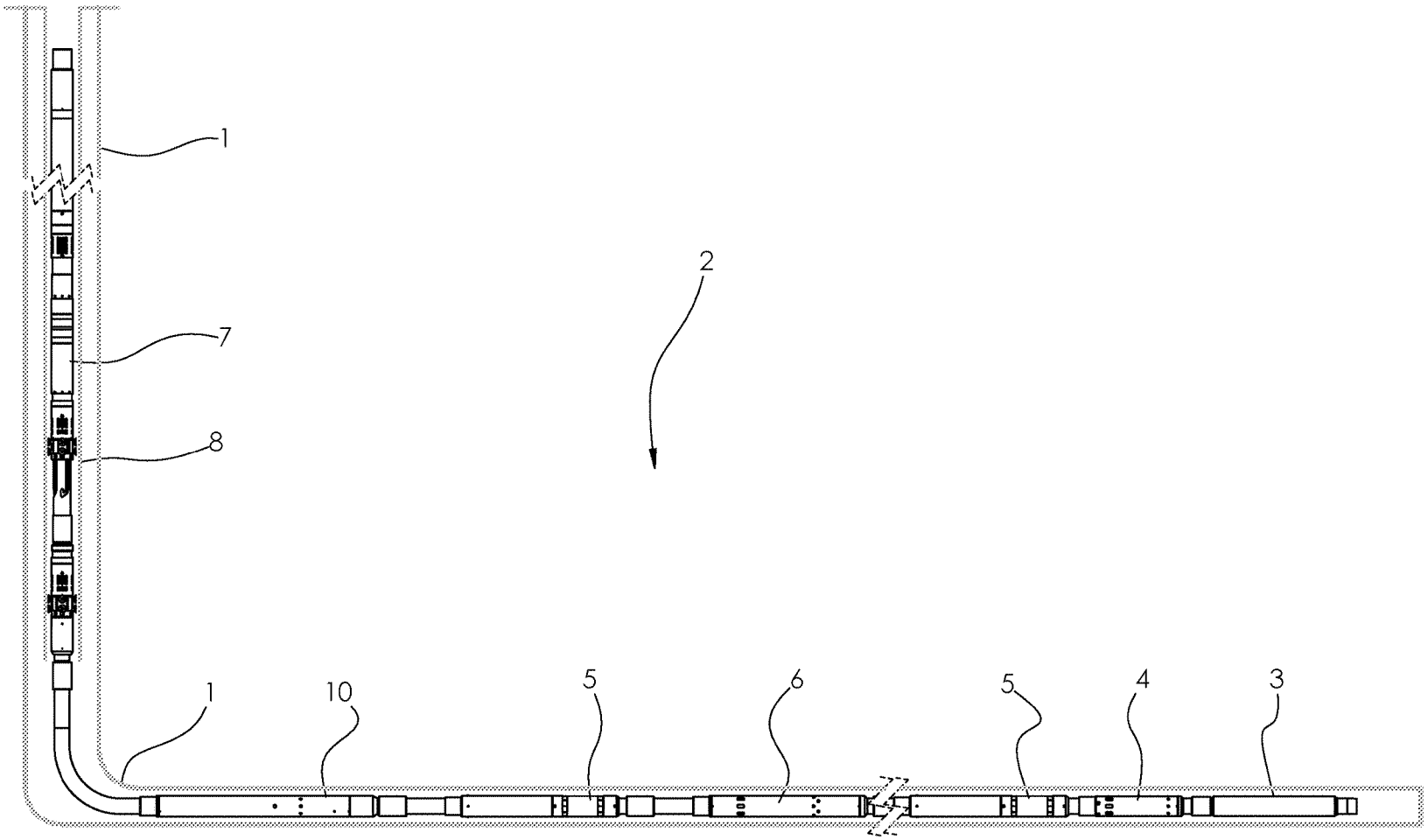
FIG. 2 is a schematic sketch of a lateral wellbore having multiple valves for controlled operation in one or more intervals of a wellbore.

FIG. 2 is a schematic simplified sketch of a lateral wellbore 1 having a production string 2 having multiple valves for controlled operation in one or more intervals of wellbore 1. A circulating sub 3 is located at the bottom of production string 2. A hydraulic frac port 4 is positioned above circulating sub 3. A series of packers 5 are located along production string 2 in the production zone of wellbore 1. Frac valves 6 are located between packers 5. A liner hanger 7 is located in the surface casing portion 8 of wellbore 1. A cement valve 10 is located beneath liner hanger 7. The several frac valves 6 separated by packers 5 provide controlled operation in one or more intervals of wellbore 1.

Figure 3:
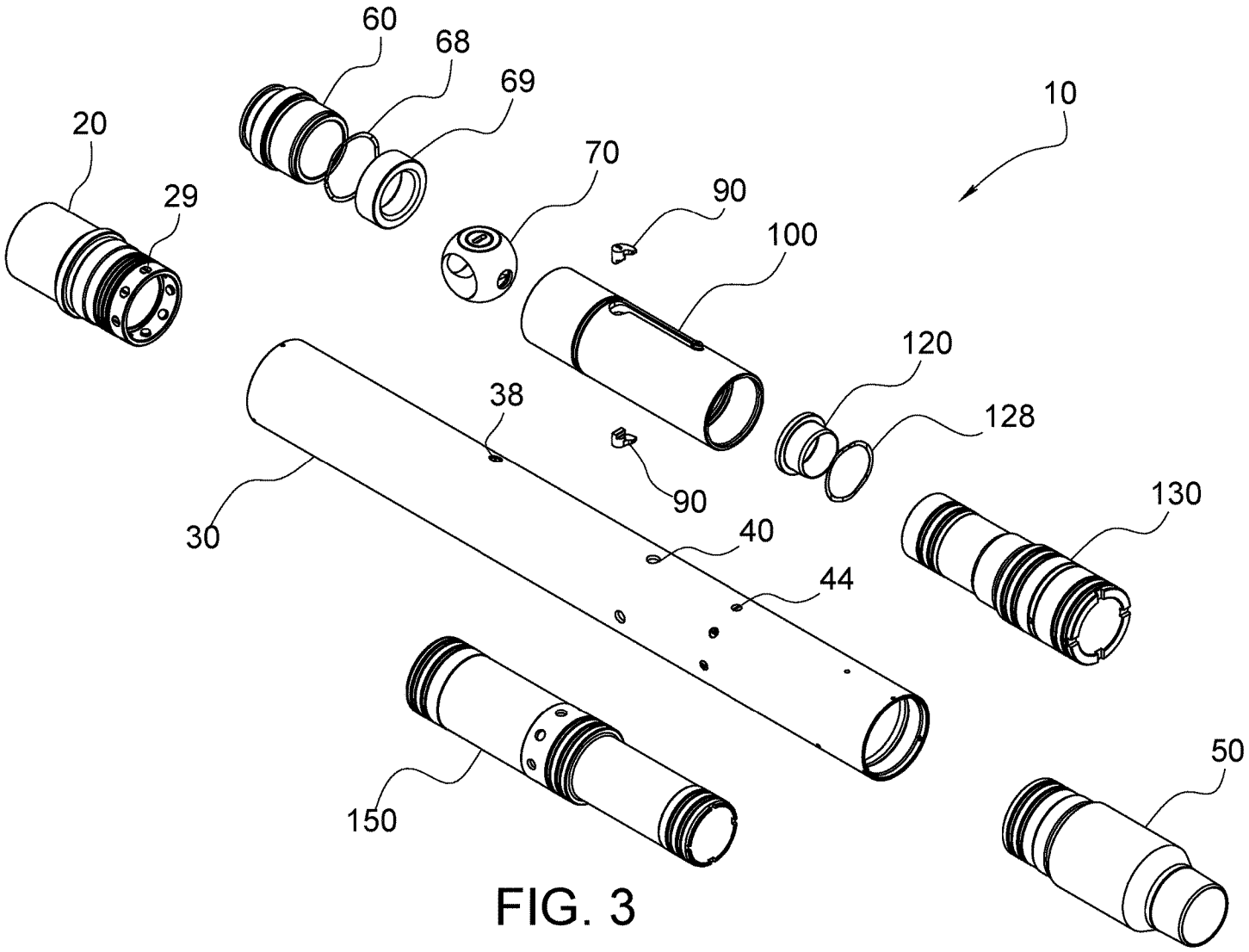
FIG. 3 is an isometric exploded view of the major components of the cement valve of the FIG. 1.

FIG. 3 is an isometric exploded view of the major components of cement valve 10 of the FIG. 1. Top sub 20 is coupled to the upper end of body 30 and bottom sub 50 is coupled to the lower end of body 30. A seat plug 60 is translatably located inside body 30, but held in position by shear pins 29 connected between it and top sub 20. (See FIG. 5). A spring 68 and an upper ball seat 69 are positioned below seat plug 60.

Figure 16:
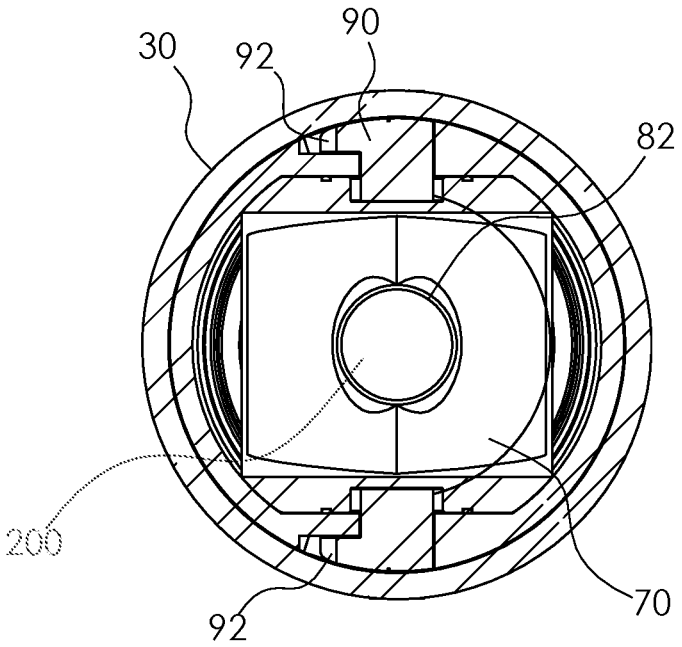
FIG. 16 is a cross-section view of an embodiment of the cement valve, illustrating the ball oriented with its converging path in substantial alignment with the centerline of the valve body.
Figure 17:
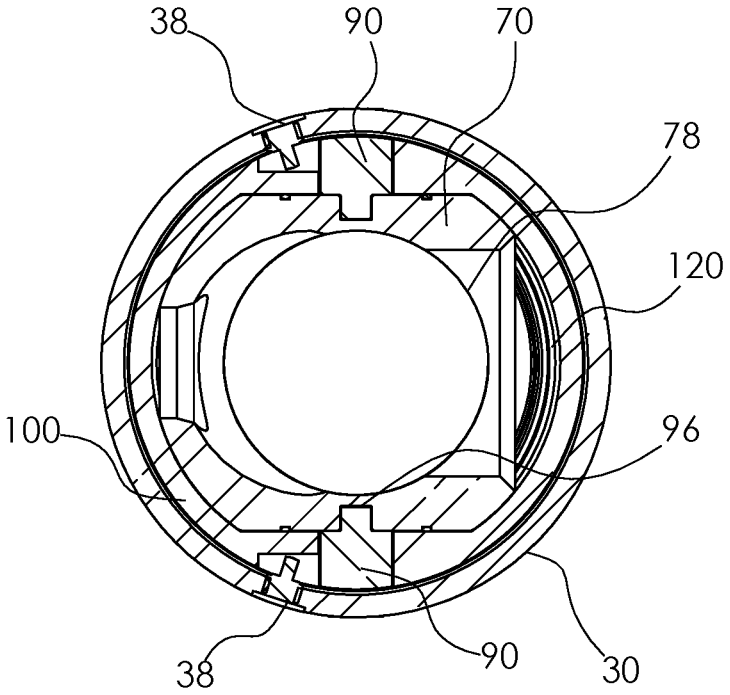
FIG. 17 is a cross-section view of an embodiment of the cement valve, illustrating the ball having been rotated ninety degrees from the position illustrated in FIG. 16, such that its flow path is in substantial alignment with the centerline of the valve body.

A perforated ball 70 is rotatably located inside a ball housing 100. Ball housing 100 is translatably located inside body 30. Ball housing 100 extends over upper ball seat 69 and spring 68 and is connected, such as by threaded connection, to seat plug 60. A lever 90 connects ball 70 to ball housing 100 as best seen in FIGS. 16-17, such that rotation of lever 90 will generate rotation of ball 70.

A valve housing 130 is connected to ball housing 100, such as by threaded connection. Connected seat plug 60, ball housing 100 and valve housing 130 are translatably located inside valve body 30, but held in position by shear pins 29 extending from top sub 20 (see FIG. 5), preventing relative movement. A guide pin 38 (see FIG. 3) extends through valve body 30 and into a guide path 114 (see also FIG. 8) on ball housing 100.

A hydraulic piston 150 is translatably located inside valve body 30, between valve housing 130 and bottom sub 50. In its "run-in" position, hydraulic piston 150 is located proximate valve housing 130, where it is held in position by piston shear pins 44 (see FIG. 18), preventing relative movement. In this position, hydraulic piston 150 blocks cement ports 40 on valve body 30 (see FIGS. 1 and 18).

Figure 4:
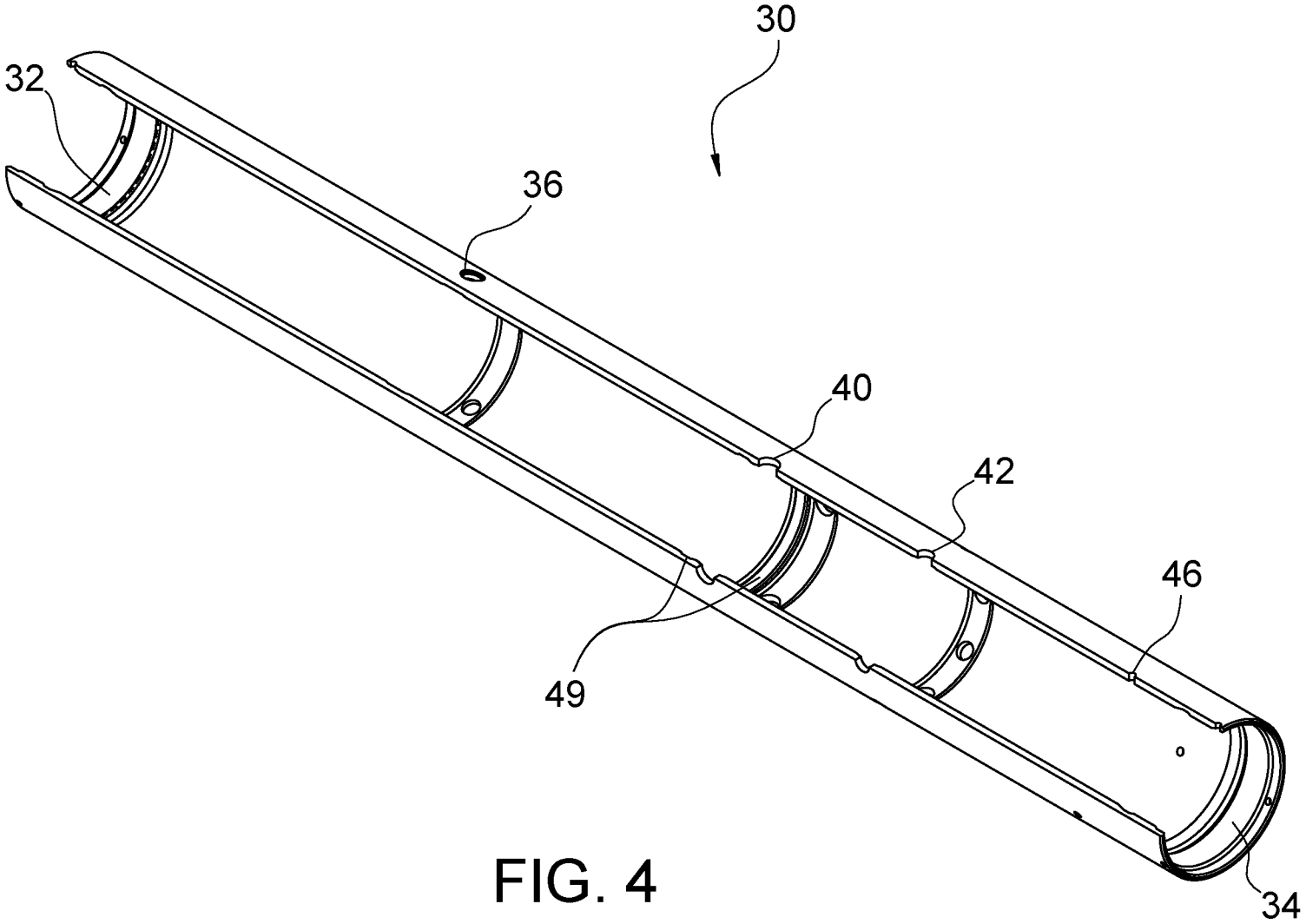
FIG. 4 is a quarter section view of the valve body of the embodiment of the cement valve of the FIG. 1.

FIG. 4 is an isometric quarter section view of valve body 30 of the embodiment of cement valve 10 of the FIG. 1. In the embodiment illustrated, an upper box connection 32 is provided at its upper end for threaded connection to top sub 20. A lower box connection 34 is provided to threaded connection to bottom sub 50.

Cement ports 40 are located on body 30. An exhaust port 46 is also located on body 30. A guide pin 38 (FIG. 1) located in pin port 36 (FIG. 4) connects body 30 to ball housing 100 at guide path 114 (FIG. 3). Shear pins 29 prevent relative movement between ball housing 100 and valve body 30. Piston shear pins 44 (FIG. 1) in pin holes 42 (FIG. 4) prevent relative movement between hydraulic piston 150 and valve body 30. Piston shear pins 44 must be sheared to allow hydraulic piston 150 to move downward relative to valve body 30 to open cement ports 40. Shear pins 29 must be sheared to allow ball housing 100 to move downward relative to valve body 30 to reclose cement ports 40 and to reopen the flow path inside valve body 30 by rotating ball 70.

Figure 5:
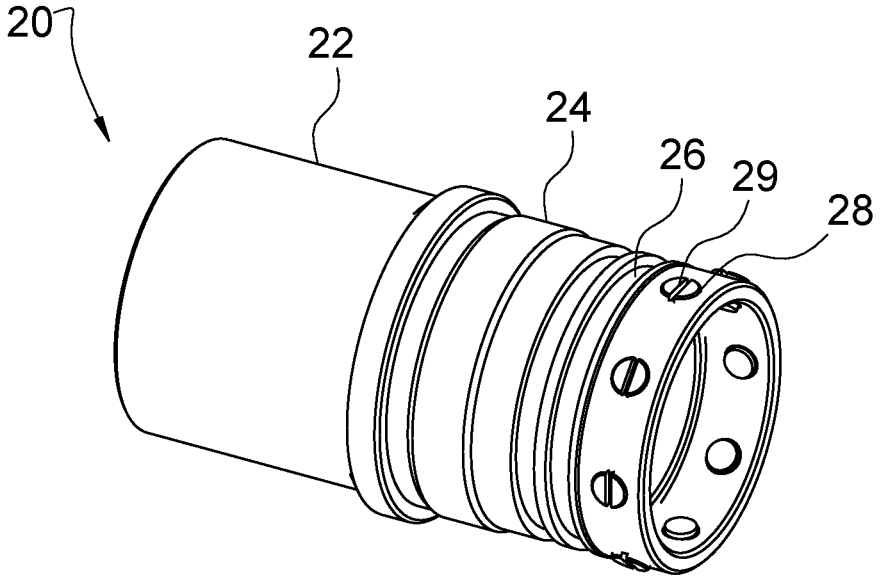
FIG. 5 is an isometric view of the top sub and shear pins of the embodiment of the cement valve of the FIGS. 1 and 3.
Figure 7:
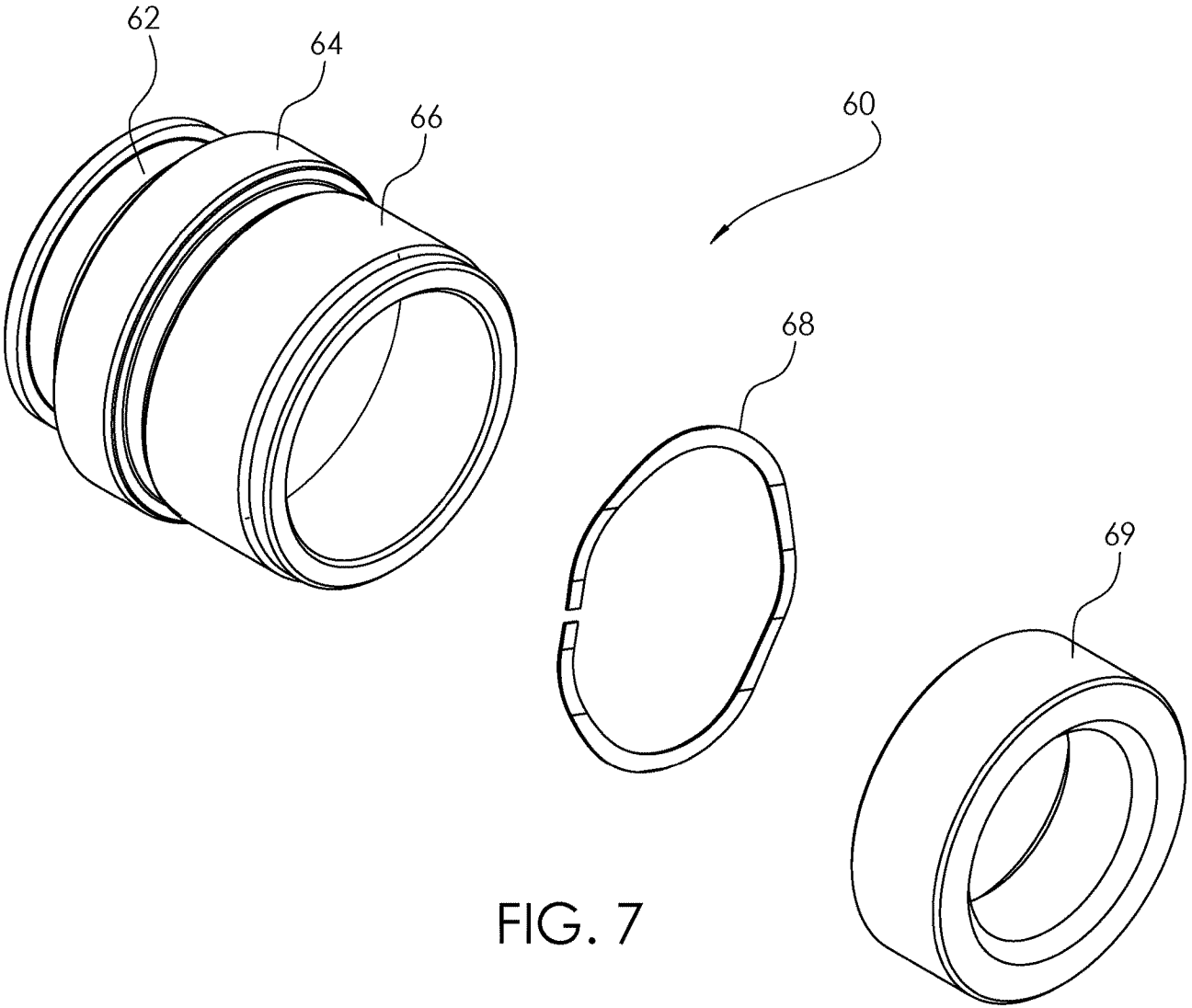
FIG. 7 is an isometric and exploded view of the seat plug, spring and upper floating valve seat of the embodiment of the cement valve of the FIGS. 1 and 3.

FIG. 5 is an isometric view of top sub 20 of the embodiment of cement valve 10 of the FIGS. 1 and 3. A box connection 22 is provided for connection to another completion string component. A threaded coupling 24 is provided for coupling to valve body 30. Seal grooves 26 are provided for O-ring seals to create a sealed connection to the interior of body 30. In the embodiment illustrated, shear pins 29 are circumferentially arranged for engagement with recess 62 of seat plug 60 (FIGS. 5 and 7). Alternative embodiments may be used to secure the assembly of the ball housing and valve to the body, such as locating shear pins through the body to engage another component connected to the valve, or to the valve itself.

Figure 6:
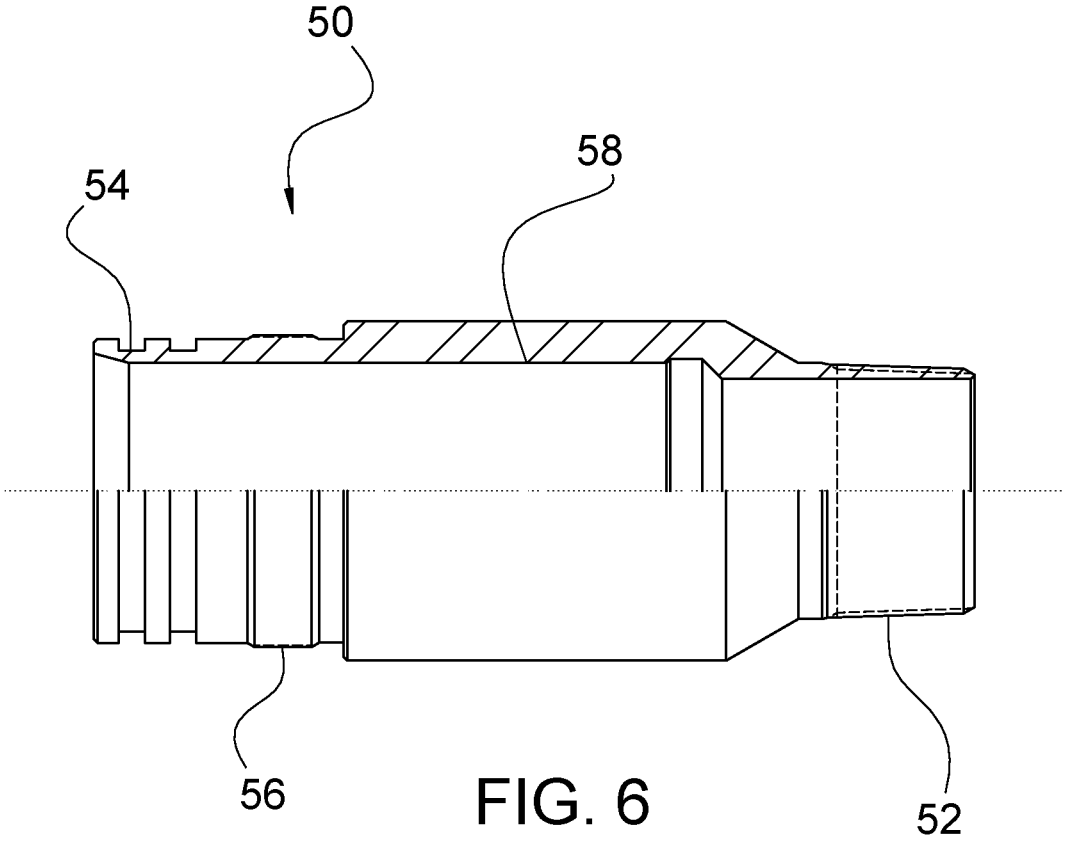
FIG. 6 is a quarter section front view of the bottom sub of the embodiment of the cement valve of the FIGS. 1 and 3.
Figure 10:
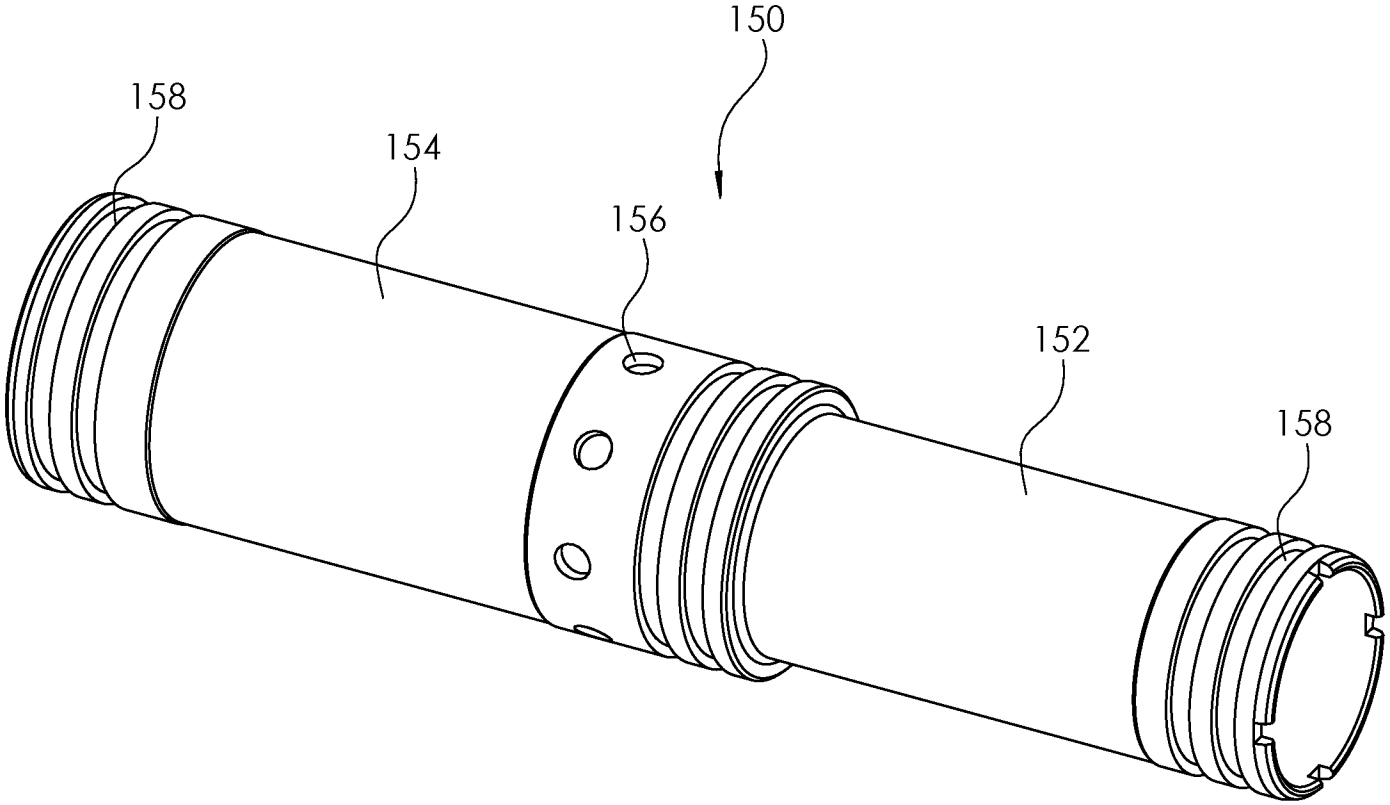
FIG. 10 is an isometric view of the hydraulic piston of the embodiment of the cement valve of the FIGS. 1 and 3.

FIG. 6 is a quarter section front view of bottom sub 50 of the embodiment of cement valve 10 of the FIGS. 1 and 3. Bottom sub 50 has an external pin 52 for connection to another completion string component. A cylinder portion 58 is provided for translatable engagement with a lower piston 152 of hydraulic cylinder 150 (FIG. 10). A threaded connection 56 is provided for coupling to valve body 30.

FIG. 7 is an isometric and exploded view of seat plug 60, spring 68 and upper ball seat 69. Seat plug 60 has a recess 62 for receiving shear pins 29. Seat plug 60 has a profile 64 for translatable fit within body 30, and a threaded portion 66 for connection to ball housing 100.

Figure 8:
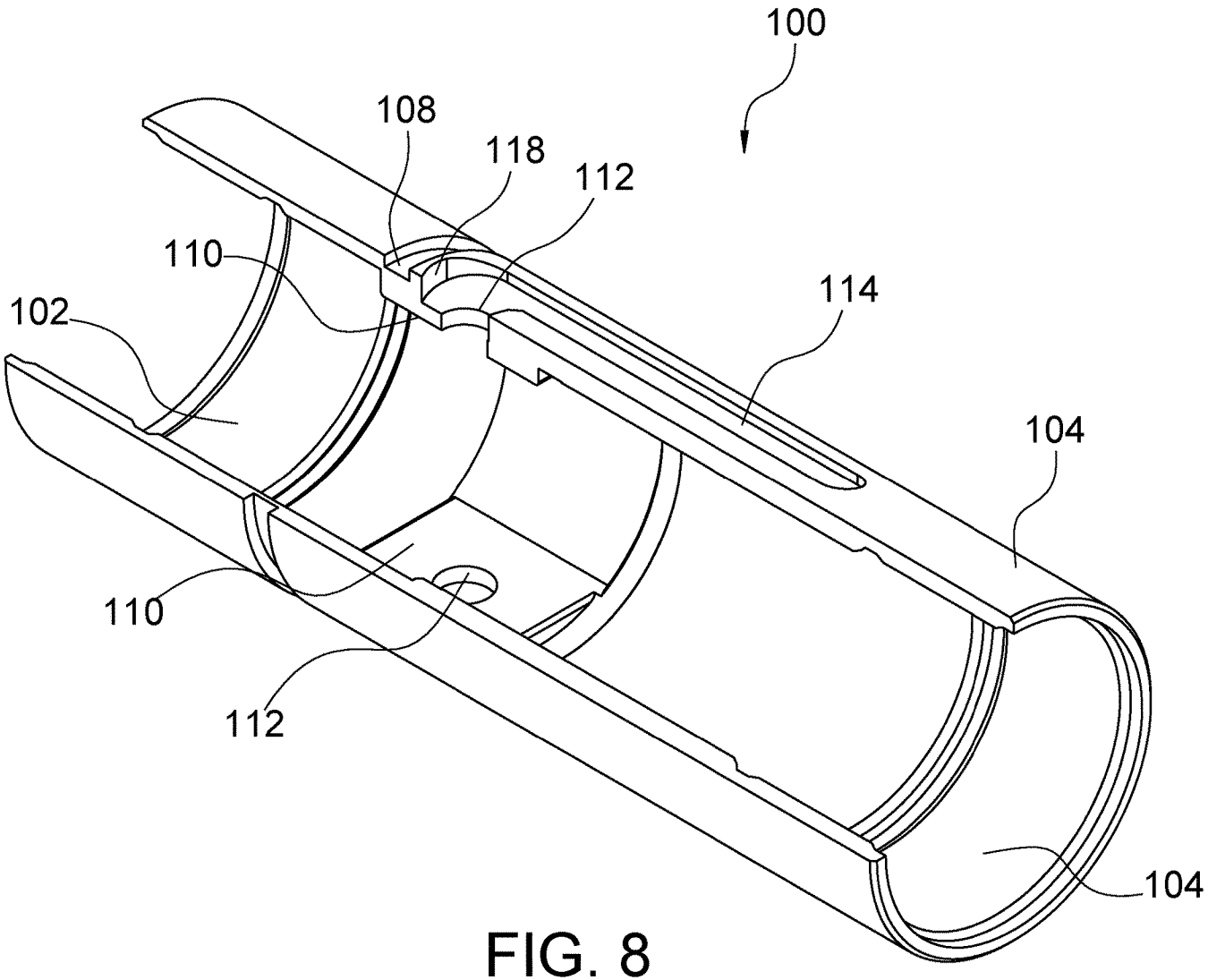
FIG. 8 is an isometric quarter-section view of the ball housing of the embodiment of the cement valve of the FIGS. 1 and 3.

FIG. 8 is an isometric quarter-section view of ball housing 100 of the embodiment of cement valve 10 of the FIGS. 1 and 3. Ball housing 100 has an upper end 102 for receiving upper ball seat 69 and for connecting to threaded portion 66 of seat plug 60. Ball housing 100 has a threaded connection 104 at its lower end for connection to valve housing 130. Seals, such as O-rings are located in seal lands 108 for sealed translatable connection to valve body 30.

In the embodiment illustrated, a pair of opposing pivot flats 110 is provided for rotatable mounting of ball 70. Lever apertures 112 extend through pivot flats 110. A guide path 114 is provided on opposing sides of the exterior of ball housing 100. Guide path 114 terminates at lever stations 118.

Figure 9:
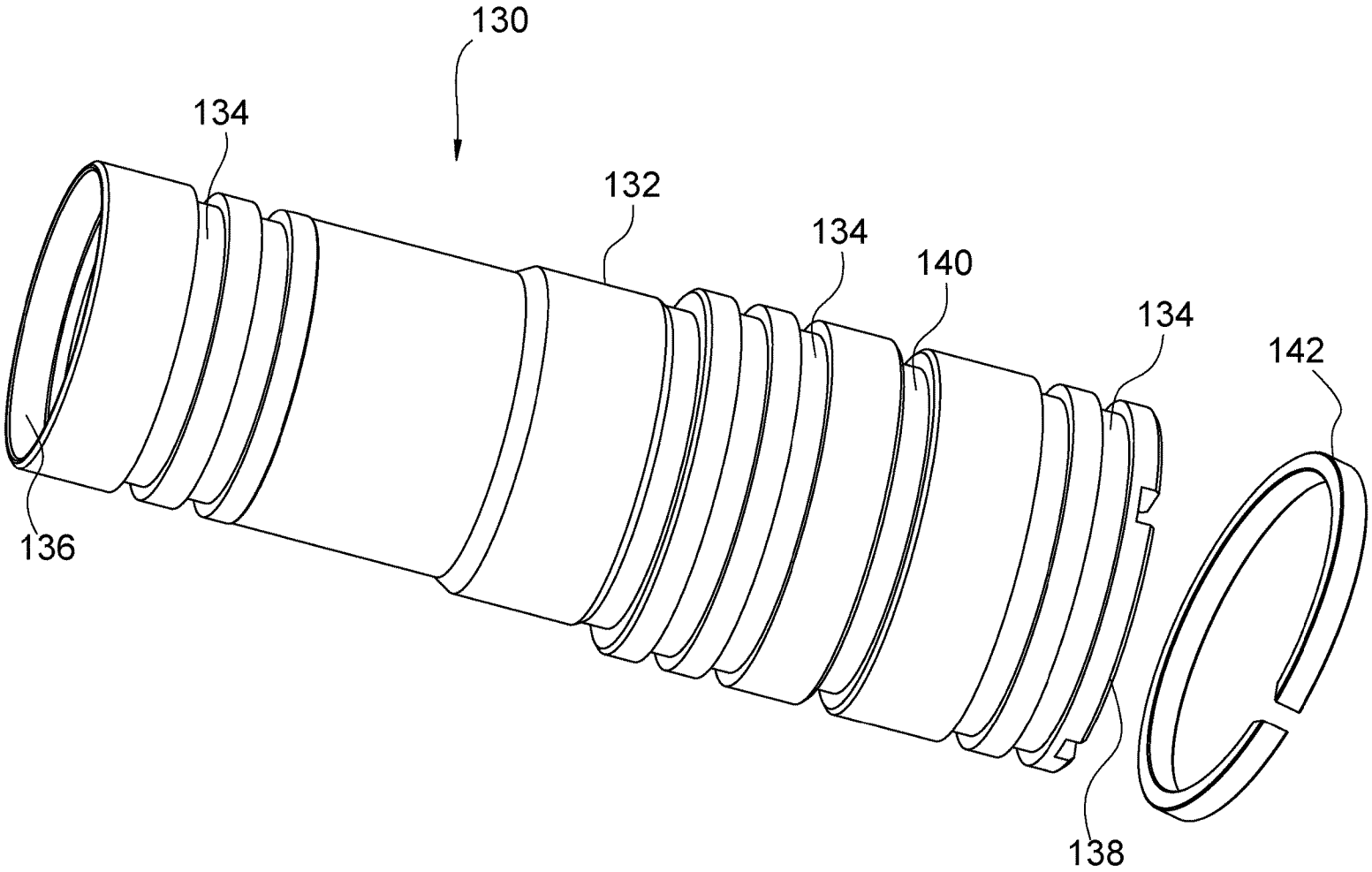
FIG. 9 is an isometric view of the valve housing of the embodiment of the cement valve of the FIGS. 1 and 3.
Figure 25:
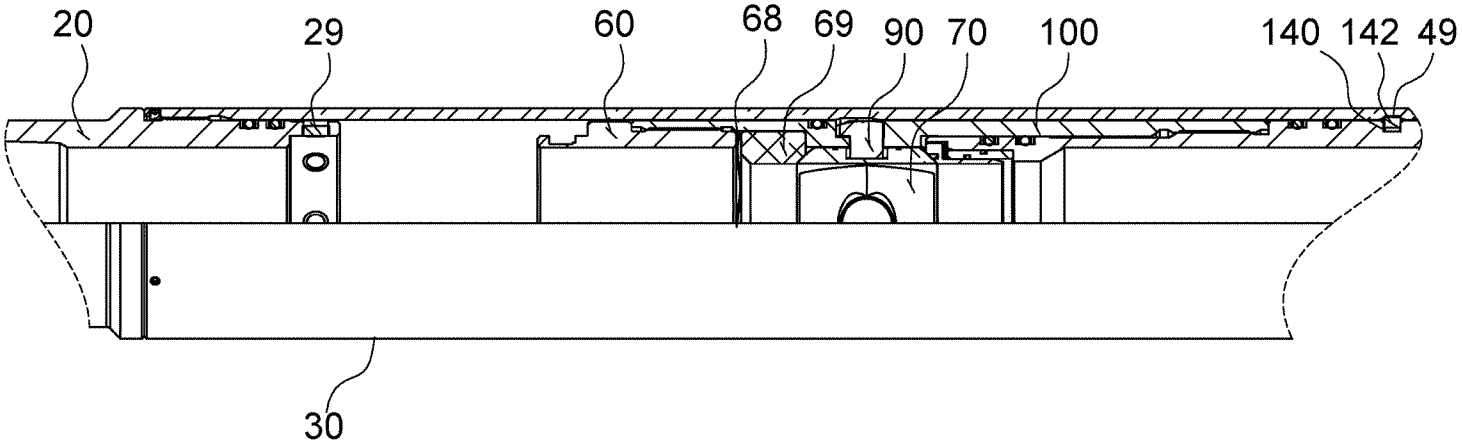
FIG. 25 is a cut-away portion of FIG. 24, enlarged for viewing.

FIG. 9 is an isometric view of valve housing 130 of the embodiment of cement valve 10 of the FIGS. 1 and 3. In the embodiment illustrated, valve housing 130 has an externally threaded connection 132 for coupling to threaded connection 104 of ball housing 100. Valve housing 130 has a receptacle 136 on its upper end for receiving spring 128 and lower ball seat 120 (FIG. 3) to provide a floating lower ball seat 120 for engagement with ball 70. When a blocking ball 200 (FIG. 16) is dropped, shear pins 29 will be sheared. At that time, as best seen in FIG. 25, seat plug 60, ball housing 100, and valve housing 130 move downward in valve body 30 to reclose cement ports 40. In this position, a lower end 138 of valve housing 130 may engage hydraulic piston 150.

O-rings are located in seal lands 134 for sealed translatable connection to valve body 30. A lock ring groove 140 has a lock ring 142 located therein. Lock ring 142 is normally compressed. Lock ring 142 expands into a lock ring groove 49 (FIG. 25) on valve body 30 when ball housing 100 and valve housing 130 move downward in valve body 30 to reclose cement ports 40, as best seen in FIG. 25.

FIG. 10 is an isometric view of hydraulic piston 150 of the embodiment of cement valve 10 of the FIGS. 1 and 3. Hydraulic piston 150 has a lower piston 152 that engages cylinder portion 58 of bottom sub 50. Hydraulic piston 150 has an upper piston 154 that engages the interior of valve body 30. Seals 158 are provided on upper piston 154 and lower piston 152. A shear pin groove or shear pin slots 156 are provided for receiving piston shear pins 44 that extend through valve body 30 to hold hydraulic piston 150 in position over cement ports 40.

Figure 11:
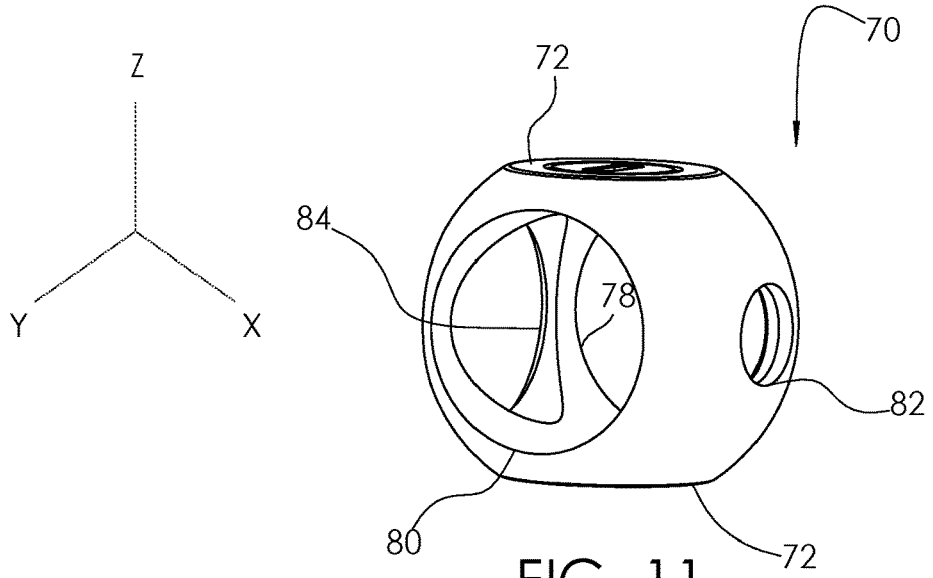
FIGS. 11 through 13 are different views of the ball of the embodiment of the cement valve of the FIGS. 1 and 3, shown variously rotated for visibility of its unique characteristics.
Figure 12:
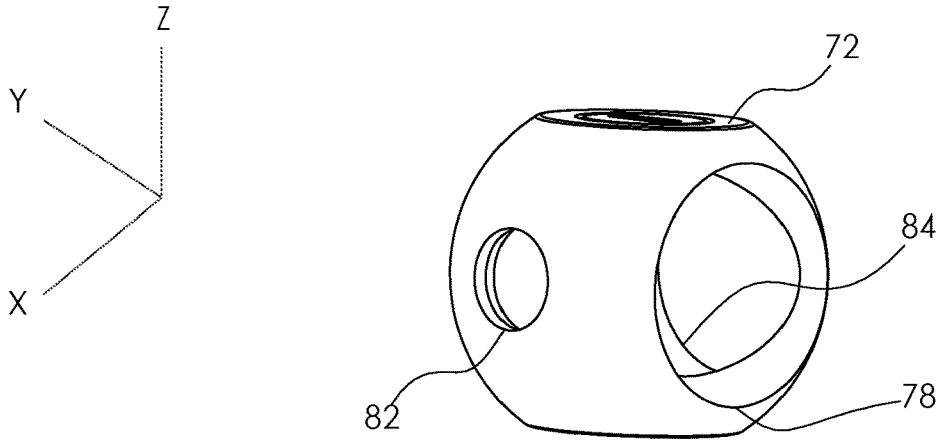
Figure 13:
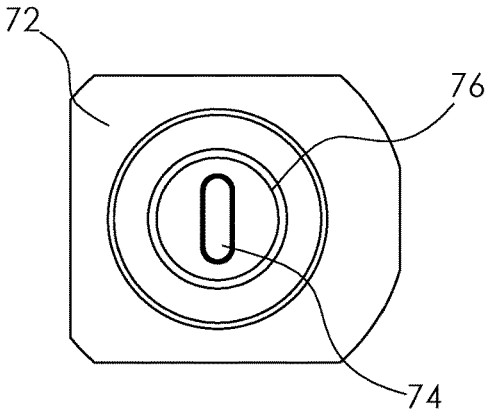

FIGS. 11 through 13 are different views of ball 70 of the embodiment of cement valve 10 of the FIGS. 1 and 3, shown variously rotated for visibility of its unique characteristics. Ball 70 has a pair of opposing flat sides 72. Referring to FIG. 13, a key slot 74 is provided on each flat side 72. Flat sides 72 of ball 70 are mounted against pivot flats 110 of ball housing 100. In the embodiment illustrated, an O-ring 76 is provided around key slot 74 for sealed engagement with pivot flats 110.

Ball 70 has two intersecting passages through it. The first path is a converging path defined by a first port 84 and a second, smaller, "ball port" 82. The second path is a flow passage defined by a third port 78 and a fourth port 80. In its initial orientation, ball 70 presents the converging path aligned with the centerline of the valve body 30 through which cement will flow. This is best seen in FIG. 16. When cementing is completed, a blocking ball 200 is dropped into the production string. Blocking ball 200 is larger in diameter than ball port 82, and smaller in diameter than port 84. Blocking ball 200 passes through first port 84 and stops to block flow through ball port 82.

Internal pressure is increased to cause shear pins 29 to be sheared, and seat plug 60, ball housing 100, and valve housing 130, move downward in valve body 30 to reclose cement ports 40. As valve housing 130 moves downward, ball 70 is rotated substantially 90 degrees to align the flow passage of third port 78 and fourth port 80 with the centerline of the valve body 30. This is best seen in FIG. 17. In this position, blocking ball 200 passes through cement tool 10.

Figure 14:
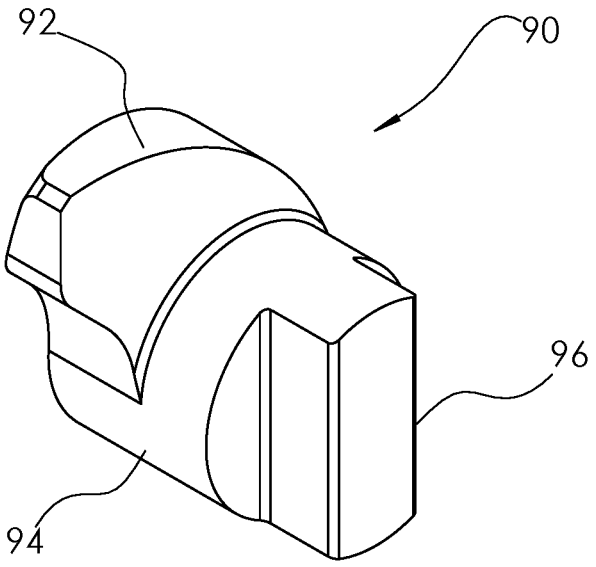
FIG. 14 is an isometric view of a lever of the embodiment of the cement valve of the FIGS. 1 and 3.
Figure 15:
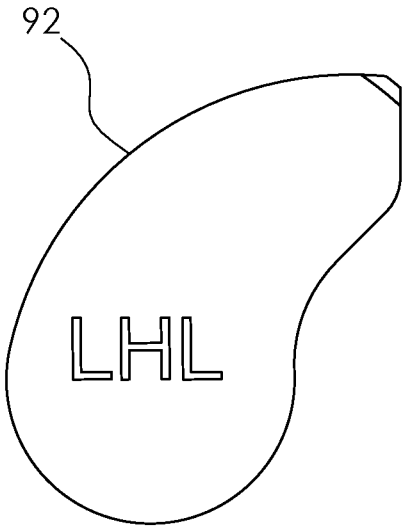
FIG. 15 is a top view of the cam portion of the lever of FIG. 14.

FIG. 14 is an isometric view of lever 90 of the embodiment of cement valve 10 of the FIGS. 1 and 3. FIG. 15 is a top view of a cam 92 of lever 90. Referring to FIG. 3, there is a lever 90 on each pivot flat 110 pivotally connecting ball 70 to ball housing 100. Lever 90 has a cam 92, a cylinder 94 and a key 96. Cylinder 94 of each lever is mounted in a lever aperture 112 on a pivot flat 110. In this position, key 96 extends inward to engage key slot 74 of ball 70. Cam 92 extends outward to present itself in lever station 118, which intersects guide path 114.

Cam 92 engages guide pin 38 in valve body 30 when ball housing 100 moves downward in valve body 30 and guide pin 38 translates guide path 114. (See FIGS. 1 and 8.) Engagement of guide pin 38 with cam 92 forces rotation of lever 90 in lever aperture 112. Key 96 of lever 90 forces rotation of ball 70.

FIG. 16 is a cross-section view of the embodiment of cement valve 10 of FIGS. 3-15, illustrating cement valve 10 having ball 70 oriented with its converging path in substantial alignment with the center of valve body 30, and ready to receive a blocking ball 200 at ball port 82.

FIG. 17 is a cross-section view of the embodiment of cement valve 10 of FIGS. 3-16, illustrating cement valve 10 having ball 70 having been rotated ninety degrees such that its flow path is in substantial alignment with the center of valve body 30. As seen in FIG. 17, guide pin 38 has engaged and rotated lever 90, and thus ball 70, and presenting third port 78 to receive flow through valve body 30.

Figure 18:
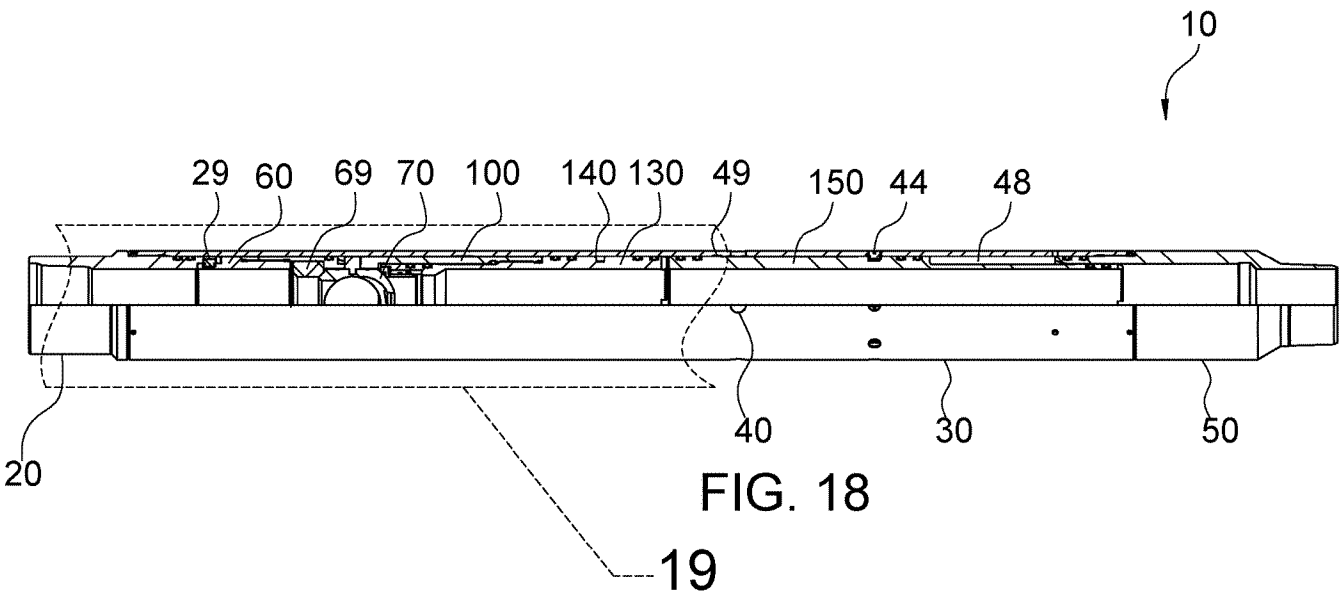
FIG. 18 is a quarter section of an embodiment of the cement valve of FIGS. 1 and 3, illustrating the cement valve as configured when initially run in the well, and with the cement ports blocked, and with the converging path of the ball in substantial alignment with the centerline of the valve body, as shown in FIG. 16.

FIG. 18 is a quarter section of the embodiment of cement valve 10 of FIGS. 3-17, illustrating cement valve 10 as configured when initially run in the well. In this configuration, cement ports 40 are blocked by hydraulic piston 150, which is held in place by piston shear pins 44. A low pressure zone 48 is formed between lower piston 152 and valve body 30 that will permit movement of hydraulic piston 150 downwards upon shearing of piston shear pins 44. In the run-in configuration, the converging path of ball 70 is in substantial alignment with the center of valve body 30 and prepared to receive blocking ball 200, as seen in FIG. 16. Top seat plug 60, ball housing 100, and valve housing 130 are held in place by shear pins 29.

Figure 19:
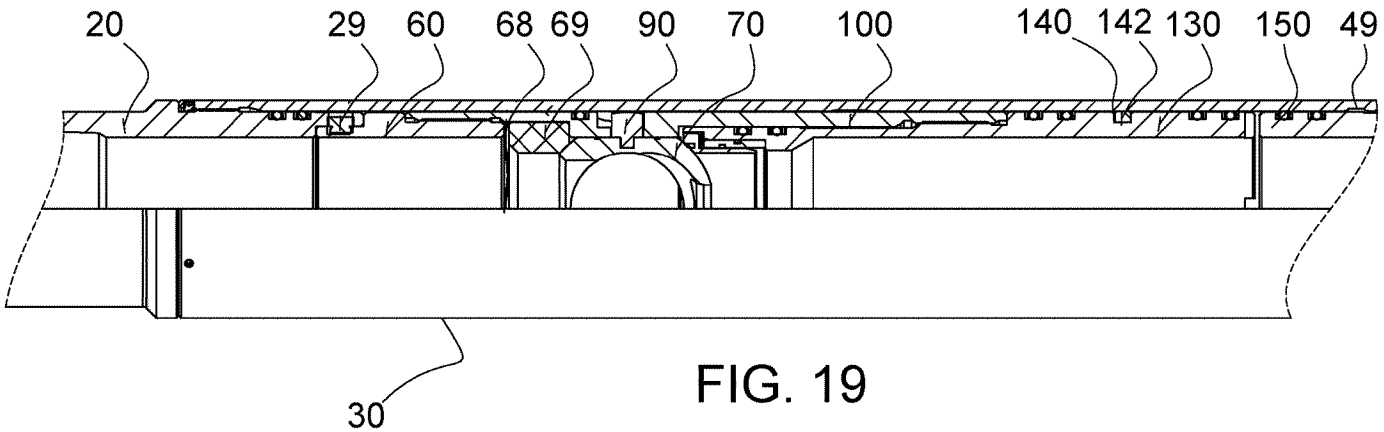
FIG. 19 is a cut-away portion of FIG. 18, enlarged for viewing.

FIG. 19 is a cut-away portion of FIG. 18, enlarged for viewing. As best seen in this view, the converging path of ball 70 is in substantial alignment with the center of valve body 30, and top seat plug 60, ball housing 100, and valve housing 130 are held in the upper locations by shear pins 29.

Figure 20:
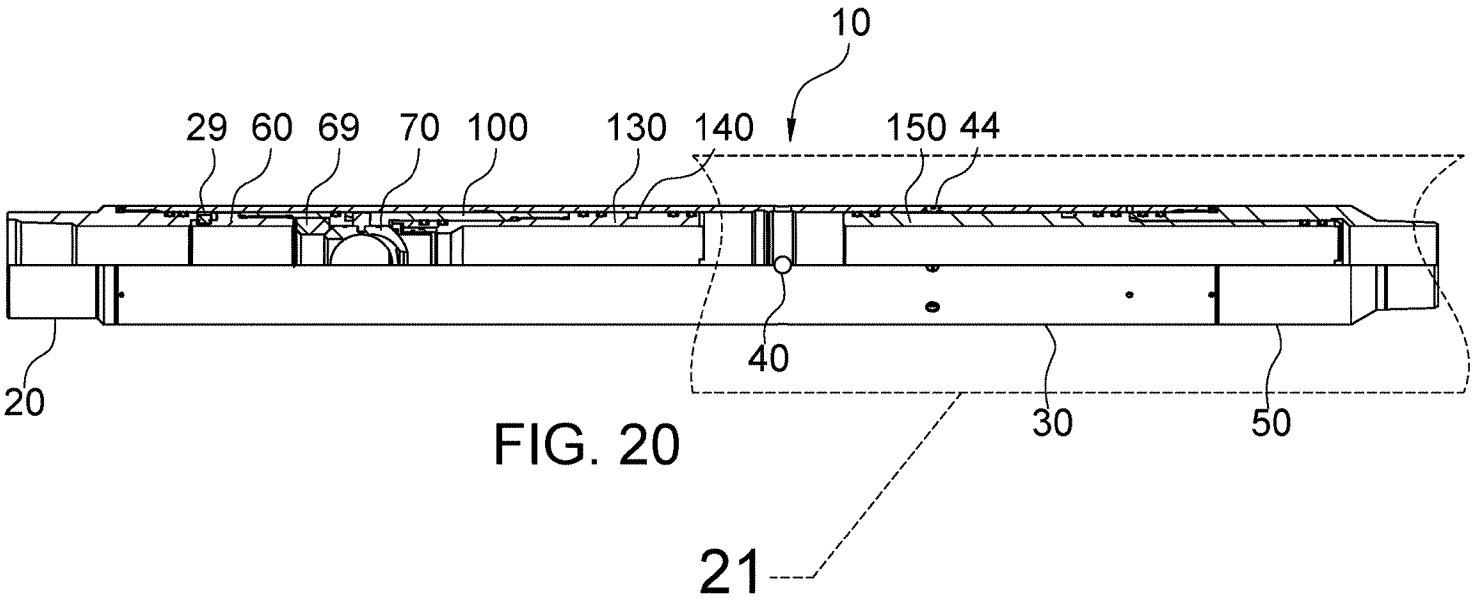
FIG. 20 is a quarter section of the embodiment of the cement valve of FIGS. 3-17, illustrating the cement valve having its hydraulic piston actuated to open the cement ports.

FIG. 20 is a quarter section of the embodiment of cement valve 10 of FIG. 18, illustrating cement valve 10 having been internally pressurized sufficiently to shear piston shear pins 44 and actuate hydraulic piston 150 downwards to open cement ports 40. In this position, cement can be pumped through cement tool 10.

Figure 21:
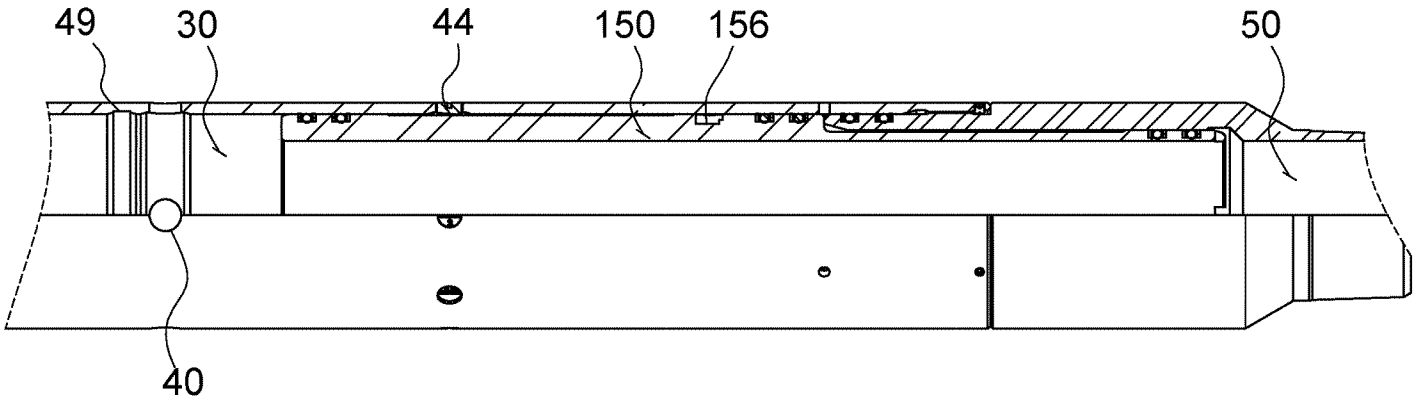
FIG. 21 is a cut-away portion of FIG. 20, enlarged for viewing.

FIG. 21 is a cut-away portion of FIG. 20, enlarged for viewing. As best seen in this view, hydraulic piston 150 has moved downward. Shear pin slots 156 are displaced from shear pins 44, and cement ports 40 are not blocked by upper pistons 154 of hydraulic piston 150.

Figure 22:
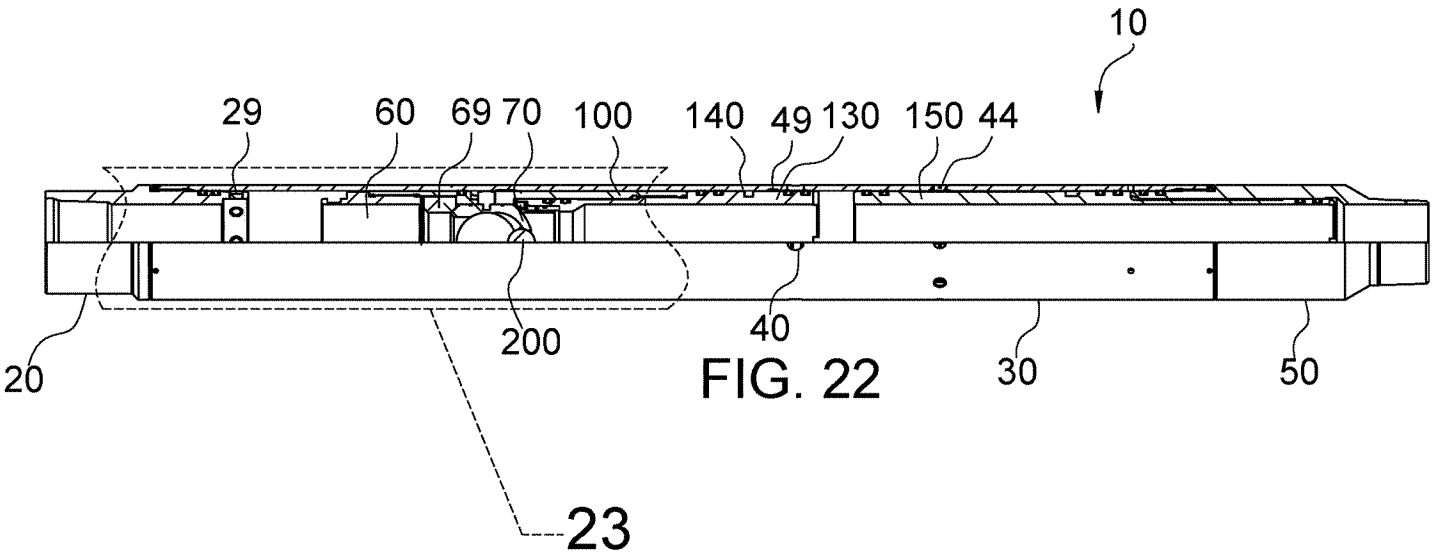
FIG. 22 is a quarter section of the embodiment of the cement valve of FIGS. 3-18, illustrating the cement valve with a blocking ball located against the ball port and the ball housing moving downwards in the valve body.

FIG. 22 is a quarter section of the embodiment of the cement valve 10 of FIG. 21, illustrating cement valve 10 with blocking ball 200 located against ball port 82 of ball 70, preventing flow through. Cement valve 10 has been internally pressurized sufficiently to shear pins 29 and force seat plug 60, ball housing 100, and valve housing 130 to move downwards in valve body 30. Guide path 114 is moving downward along guide pin 38 as ball housing 100 moves downward.

Figure 23:
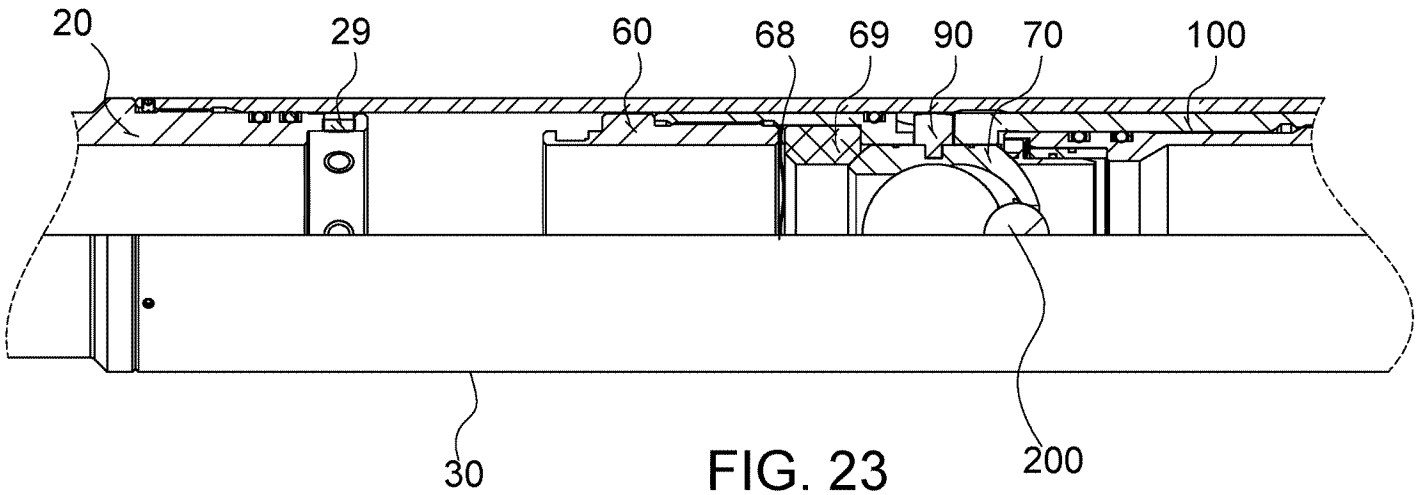
FIG. 23 is a cut-away portion of FIG. 22, enlarged for viewing.

FIG. 23 is a cut-away portion of FIG. 22, enlarged for viewing. As best seen in this view, guide pin 38 has not yet caused rotation of lever 90, so ball 70 remains with the converging path, blocked by blocking ball 200, and aligned with the centerline of cement tool 10.

Figure 24:
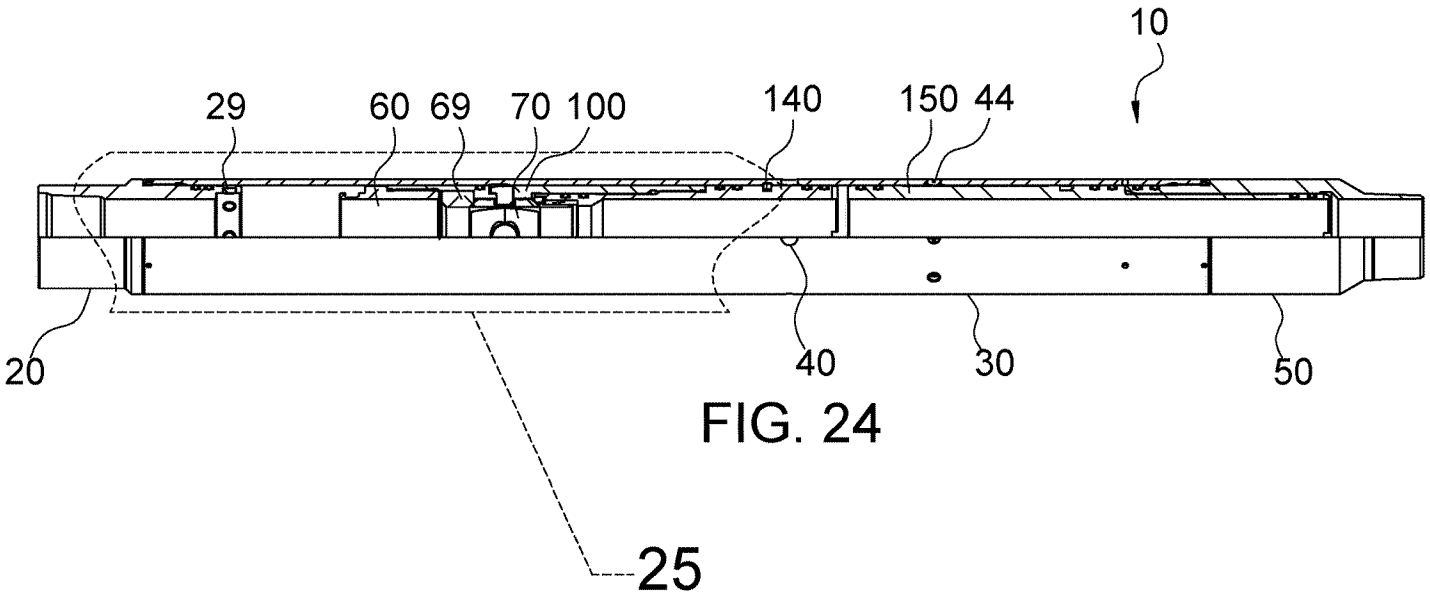
FIG. 24 is a quarter section of the embodiment of the cement valve of FIGS. 3-19, illustrating the cement valve with the valve housing blocking the cement ports and the ball rotated ninety degrees with its flow path in substantial alignment with the center of the valve body, as in FIG. 16.

FIG. 24 is a quarter section of the embodiment of the cement valve of FIG. 23, illustrating a further progression of movement from that of FIG. 23. In FIG. 24, seat plug 60, ball housing 100, and valve housing 130 have moved further downward. Guide pin 38 has engaged cam 92 of lever 90 and caused rotation of lever 90 and thus ball 70.

Cement valve 10 now has valve housing 130 blocking cement ports 40, and ball 70 is rotated ninety degrees with its flow path in substantial alignment with the centerline of valve body 30, as in FIG. 17. In the embodiment illustrated, lock ring 142 has expanded into a lock ring groove 49 on the interior wall of valve body 30 to secure valve housing 130 in place over cement ports 40. With cement ports 40 reclosed, it is possible to commence fracking operations without the need to set a plug, wait on cement, and drill out the plug, resulting in a significant savings of time and cost.

FIG. 25 is a cut-away portion of FIG. 24, enlarged for viewing. As best seen in this view, guide pin 38 has engaged cam 92 of lever 90 and rotated lever 90 and ball 70. Ball 70 is rotated ninety degrees to present is flow path in substantial alignment with the centerline of valve body 30, as in FIG. 17. In this position, blocking ball 200 is released and no longer blocks the flow of fluid through cement valve 10.

If used herein, the term "substantially" is intended for construction as meaning "more so than not."

In an alternative embodiment, not shown, seat plug 60 and upper ball seat 69 are a single component. Similar component unities and divisions can be readily made by a person of ordinary skill in the art without departing from the spirit and novelty of the present disclosed embodiments.

Having thus described the several embodiments, it is noted that the embodiments disclosed are illustrative rather than limiting in nature and that a wide range of variations, modifications, changes, and substitutions are contemplated in the foregoing disclosure and, in some instances, some features of the present disclosure may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the embodiments disclosed.

The invention claimed is:

1. A cement valve for a subterranean completion system, comprising:

a valve body having an upper end and a lower end and having cement ports therebetween;

a ball housing translatably located in the valve body;

a guide pin extending between the valve body and the ball housing;

a ball rotatably mounted in the ball housing, the ball comprising;

a converging path extending between a first port and a ball port on the ball;

a flow path extending between a third and fourth port on the ball;

the converging path perpendicular to, and intersecting with, the flow path;

a lever connected to the ball;

wherein translation of the ball housing relative to the valve body engages the guide pin with the lever and rotates the ball; and, wherein moving the ball housing towards the lower end of the valve body closes the cement ports.

2. The cement valve of claim 1, further comprising: the lever extends through an aperture in the ball housing to connect the ball to the ball housing in rotatable relation.

3. The cement valve of claim 1, further comprising: rotation of the ball aligns the flow path with a centerline of the cement tool.

4. The cement valve of claim 1, further comprising: a pair of opposing flats oriented perpendicular to each of the first port and ball port, and to the third port and the fourth port; the lever extending into a guide path on the ball housing; and, the lever having a cam portion positioned for engagement with the guide pin.

5. The cement valve of claim 1, further comprising shear pins to prevent translation of the ball housing inside the valve body until the shear pins are sheared.

6. The cement valve of claim 1, further comprising: wherein rotating the ball ninety degrees aligns the flow path of the ball with the center of the valve body.

7. A cement valve for a subterranean completion system, comprising; a valve body having an upper end and a lower end and having cement ports therebetween; a ball housing translatably located in the valve body; and, a guide pin extending between the valve body and the ball housing; a ball rotatably mounted in the ball housing, the ball comprising; a converging path extending between a first port and a ball port on the ball; a flow path extending between a third and fourth port on the ball; the converging path perpendicular to, and intersecting with, the flow path; and, a lever connected to the ball; wherein translation of the ball housing relative to the valve body engages the guide pin with the lever and rotates the ball; and, a hydraulic piston translatably boated inside the valve body; the hydraulic piston aligned with the cement ports to prevent flow through the cement ports; and, piston shear pins preventing translation of the piston inside the valve body; wherein sufficiently pressurizing the interior of the valve body shears the piston shear pins and forces the hydraulic piston towards the lower end of the valve body to open the cement ports.

* * * * *